US005347353A

United States Patent [19]

Fletcher

[11] Patent Number: 5,347,353

[45] Date of Patent: Sep. 13, 1994

[54] TANDEM HIGH PRODUCTIVITY COLOR ARCHITECTURE USING A PHOTOCONDUCTIVE INTERMEDIATE BELT

[75] Inventor: Gerald M. Fletcher, Pittsford, N.Y.

[73] Assignee: Xerox Corporation, Stamford, Conn.

[21] Appl. No.: 125,728

[22] Filed: Sep. 24, 1993

[51] Int. Cl.[5] ..... G03G 21/00

[52] U.S. Cl. ..... 355/326 R; 346/160; 355/271; 355/272; 355/327

[58] Field of Search ..... 355/210, 212, 245, 271, 355/274, 277, 326 R, 327; 346/160

[56] References Cited

U.S. PATENT DOCUMENTS

| | | | |
|---|---|---|---|
| 4,515,460 | 5/1985 | Knechtel | 355/327 |
| 4,847,642 | 7/1989 | Murayama et al. | 346/160 X |
| 4,994,858 | 2/1991 | Lubberts | 355/212 |
| 5,070,369 | 12/1991 | Mahoney et al. | 355/271 |
| 5,086,318 | 2/1992 | Takeda et al. | 355/271 |
| 5,117,261 | 5/1992 | Sakai et al. | 355/272 X |
| 5,138,389 | 8/1992 | Randall | 355/272 |
| 5,160,946 | 11/1992 | Hwang | 355/327 X |
| 5,198,864 | 3/1993 | Fletcher . | |
| 5,257,037 | 10/1993 | Haneda et al. | 346/160 |
| 5,314,774 | 5/1994 | Camis | 355/245 X |

*Primary Examiner*—A. T. Grimley
*Assistant Examiner*—Sandra L. Brasé
*Attorney, Agent, or Firm*—Oliff & Berridge

[57] ABSTRACT

Tandem, high productivity color images are formed by using a photoconductive belt as an imaging surface and as a transferring device. A multi-colored image is produced comprising a plurality of color layers. The apparatus includes a charging device, an image forming device, and a developing device located along a photoconductive belt to form a toned image layer on the belt. Additional color layers may be provided by either photoreceptive imaging drums or additional photoconductive belts.

27 Claims, 7 Drawing Sheets

TANDEM HIGH PRODUCTIVITY COLOR ARCHITECTURE USING A PHOTOCONDUCTIVE INTERMEDIATE BELT

BACKGROUND OF THE INVENTION

1. Field of the Invention

This invention relates generally to a system for producing a multi-toned image in an electrostatographic printing apparatus. More particularly, this invention relates to an apparatus for enabling a photoconductive intermediate transfer member to produce toned images and receive toned images from additional imaging devices.

2. Description of Related Art

Generally, electrostatographic copying is performed by exposing an image of an original document onto a substantially uniformly charged photoreceptive member. The photoreceptive member has a photoconductive layer. Exposing the charged photoreceptive member with the image discharges areas of the photoconductive layer corresponding to non-image areas of the original document, while maintaining the charge in the image areas. Thus, a latent electrostatic image of the original document is created on the photoconductive layer of the photoreceptive member. Charged developing material is subsequently deposited on the photoreceptive member. The developing material may be a liquid material or a powder material. The developing material is attracted to the charged image areas on the photoconductive layer. This attraction converts the latent electrostatic image into a visible toned image. The visible toned image is then transferred from the photoreceptive member, either directly or after an intermediate transfer step, to a copy sheet or other support substrate to create an image which is permanently affixed to the copy sheet, providing a reproduction of the original document. In a final step, the photoconductive surface of the photoreceptive member is cleaned to remove any residual developing material to prepare the photoreceptive member for successive imaging cycles.

This electrostatographic copying process is well known and is commonly used for light lens copying of an original document. Analogous processes also exist in other statographic printing applications, such as, for example, ionographic printing and reproduction, where a charge is deposited on a charge-retentive surface in response to electronically generated or stored images.

In multi-color electrostatographic printing, rather than forming a single latent image on the photoconductive surface, successive latent images, corresponding to different colors, must be created. Each single color latent electrostatic image is developed with a corresponding colored toner. This process is repeated for a plurality of cycles. Each single-color toner image is superimposed over the previously transferred single-color toner image(s) when it is transferred to the copy sheet. This creates a multilayered toner image on the copy sheet. Thereafter, the multilayered toner image is permanently fixed to a copy sheet, creating a full-color copy.

In tandem color printing, four imaging systems are typically used. Photoconductive drum imaging systems are typically employed in tandem color printing due to the compactness of the drums. Although drums are used in the preferred embodiments, a tandem system alternately uses four photoconductive imaging belts instead of the drums. Each imaging drum system charges the photoconductive drum, forms a latent image on the drum, develops a toned image on the drum and transfers the toned image to an intermediate belt. In this way, yellow, magenta, cyan, and black single-color toner images are separately transferred to the intermediate transfer belt. When superimposed, these four toned images are capable of producing a wide variety of colors.

However, a user may desire a specialty color which cannot be properly produced using the conventional tandem imaging device. In such circumstances, the user must physically remove one of the imaging drum systems, replacing it with an imaging drum system set up to form a toned image in the specialty color. Such a process requires considerable interaction by the user. Alternatively, a fifth imaging drum system can be added for the specialty color. However, this increases both the machine size and the system cost.

Furthermore, because of size limitations of copying machines, the physical space within a copy machine can usually accommodate no more than four photoconductive drums. If the user desires a specialty color, the user must either obtain a copier specially designed to accommodate more than four photoconductive imaging drum systems or remove one of the photoconductive imaging drum systems each time the user wants to print using a specialty color. Such systems waste a great deal of time and effort. Furthermore, even if a fifth specialty color is not required, it is still desirable to reduce the size and cost in a multicolor intermediate transfer system.

A plurality of bias rollers or other similar conductive contacting members, with different potentials on the contacting members, may be used near the transfer zone of each photoconductive drum to tailor the electrostatic fields used in transferring. General "field tailoring" principals are known, as indicated in U.S. Pat. No. 5,198,864, the disclosure of which is incorporated herein by reference. The same general principals apply in transfers to a photoconductive intermediate belt when the belt substrate is semiconductive. Field tailoring helps reduce the unwanted electrostatic fields that otherwise extend across air gaps prior to intimate contact between the intermediate belt surface and the toner image on the surface of the drum.

Additionally, when using an intermediate belt transfer system, a toned image typically undergoes two electrostatic transfers before being fixed to a copy sheet. The first transfer occurs when each toned image is transferred from the photoconductive imaging drum system to the intermediate belt. The second transfer occurs when the intermediate belt transfers a multi-toned image to a copy sheet or another similar belt for transfer to the copy sheet. Because of the adhesive forces involved in transferring toned images, each transfer step can result in toner being lost or smeared. Typically, certain toner colors are found to be more easily lost or smeared in transfer systems than other color toners used in the transfer process. This is due to many factors related to toner design, such as different charge distributions, sizes, or material additives for charge or development control, causing different adhesion constants for the different toners. Different toner systems will have different high adhesion toner colors depending on the details of the toner materials of each color in the system. The number of transfers a toned image undergoes should therefore be minimized, especially for the least adhesive color toner in the system.

SUMMARY OF THE INVENTION

This invention solves these problems. In standard tandem color copying using four toners, this invention eliminates one of the photoconductive imaging drum systems by using the intermediate belt as an imaging device in place of a fourth photoconductive imaging drum system. Thus, this invention reduces the number of parts in a tandem color printer.

Furthermore, this invention avoids transferring one of the toned images twice because one latent image is formed directly on the intermediate transfer belt rather than on one of the photoconductive imaging drums. Therefore, one of the toned images is transferred only once from the intermediate belt to the copy sheet. Thus, many problems arising from transferring a toned image twice, such as the loss and smearing of toner, are avoided for the singly-transferred colored toner. In practice, the least adhesive color toner in a particular system is chosen to be imaged directly onto the photoconductive intermediate belt.

Additionally, in a second embodiment, a fifth color is imaged and developed directly on the photoconductive intermediate belt without a major increase in machine size. A user is then able to use a specialty color in tandem color printing much more easily. A user desiring to use a specialty color merely needs to ensure that the appropriate toner is properly in place. The user is no longer required to physically remove a photoconductive imaging drum system and replace it with a photoconductive imaging drum system capable of producing a specialty color. Thus, this invention allows the user to automatically select and produce a five-color toned image with minimal changes to the apparatus.

This invention provides an apparatus for producing an image comprising a plurality of colored layers on an image receiving member. The apparatus comprises a photoconductive belt, a charging means for charging a portion of the belt, a first image forming means for forming a latent electrostatic image on the belt in the charged region, a first developing means for forming a first toned image from the latent image on the belt, wherein the first toned image is one of the color layers, a plurality of second image forming means, each forming an additional developed image capable of being transferred to the belt in the charged region, each additional developed image forming a different one of the colored layers, a plurality of image transferring means for transferring each additional developed image from the plurality of second image forming means to the belt in the charged region to form a multilayered image, and a second image transferring means for transferring the multilayered image formed on the belt to an image receiving member.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENTS

Figure 1:
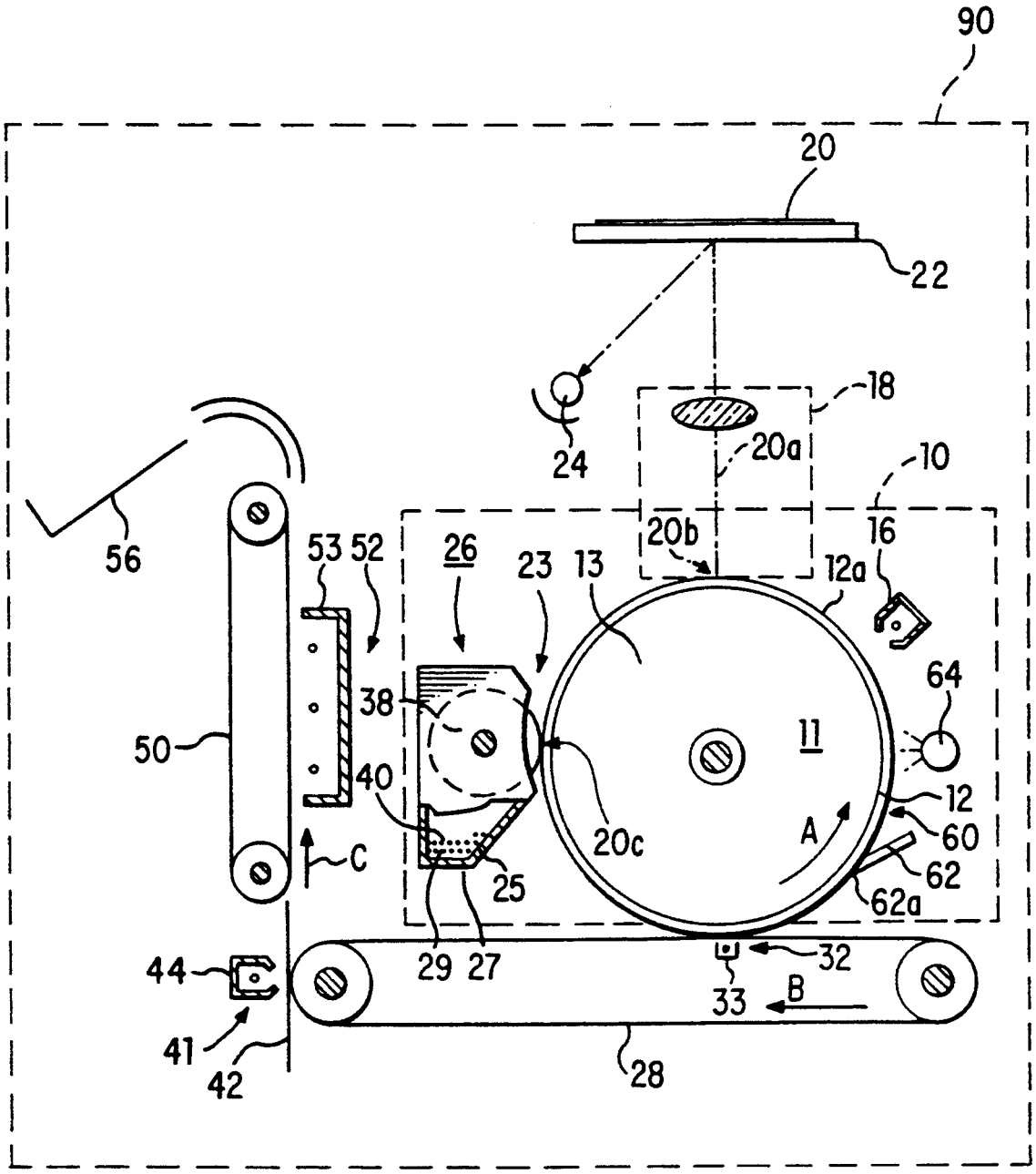
FIG. 1 is a schematic diagram of pertinent portions of the photoreceptive imaging drum system and an intermediate belt transfer member.

As shown in FIG. 1, an electrophotographic copying apparatus 90 comprises an image forming device 10. The image forming device 10 comprises a drum 11 having an electrically-grounded, conductive substrate 13. A photoconductive layer 12 is deposited on the electrically-grounded conductive substrate 13. A series of processing stations for charging, exposing, developing, transferring and cleaning are positioned about the drum 11, such that as the drum 11 rotates in a direction of arrow A, the drum 11 transports a portion of the photoconductive surface **12*a* of the photoconductive layer 12 sequentially through each of the processing stations. The drum 11 is driven at a predetermined speed relative to the other machine operating mechanisms by a drive motor (not shown). Timing detectors (not shown) sense the rotation of the drum 11** and communicate with machine logic (not shown) to synchronize the various operations of the copying apparatus so that the proper sequence of operations is produced at each of the respective processing stations.

Initially the drum 11 rotates the photoconductive layer 12 past a charging station 16. The charging station 16 is generally a corona generating device. The charging station 16 sprays ions onto the photoconductive surface **12*a* to produce a relatively high, substantially uniform charge on the photoconductive layer 12**.

Once the photoconductive layer 12 is charged, the drum 11 rotates to an exposure station 18 where a light image of an original document 20 is projected onto the charged photoconductive surface **12*a*. The exposure station 18 is generally a laser ROS. Alternatively, the exposure station 18 is a moving lens system. The original document 20 is positioned face down upon a generally planar, substantially transparent platen 22. A plurality of lamps 24 are synchronously moved with the lens system 18 to incrementally scan the original document 20 onto the photoconductive surface 12*a*. In this manner, a scanned light image 20*a* of the original document 20 is projected onto the photoconductive surface 12*a* of the drum 11. The scanned light image 20*a* selectively dissipates the charge on the photoconductive surface 12*a* to form a latent electrostatic image 20*b* corresponding to the image of the original document 20. While the preceding description relates to a light lens system, one skilled in the art will appreciate that other devices, such as a modulated laser beam may be employed to selectively discharge the charged photoconductive layer 12 to form the latent electrostatic image 20*b***.

After exposure, the drum 11 rotates the latent electrostatic image **20*b* formed on the surface 12*a* of the photoconductive layer 12 to a development station 23. The development station 23 is, in one embodiment, a developer unit 26 comprising a magnetic brush development system to deposit developing material 25 onto the latent electrostatic image 20b. The magnetic brush developing system 26 includes a single developer roll 38 disposed in a developer housing 40. In the developer housing 40, toner particles 27 are mixed with carrier beads 29 to generate an electrostatic charge between the toner particles 27 and the carrier beads 29. The electrostatic charge causes the toner particles 27 to cling to the carrier beads 29 to form the developing material 25. The developer roll 38 rotates and attracts the developing material 25. Subsequently, as the magnetic roll rotates, developing material 25 is brought into contact with the photoconductive surface 12a. The latent electrostatic image 20b formed in the photoconductive layer 12 attracts the charged toner particles 27 of the developing material 25 to develop the latent electrostatic image 20b on the photoconductive surface 12a into a toned image 20c**. Many other conventional toner development systems may be employed in accordance with the preferred embodiments. Furthermore, this invention is not limited to dry toner development systems and is used equally suited for use with liquid toner development systems.

Figure 3:
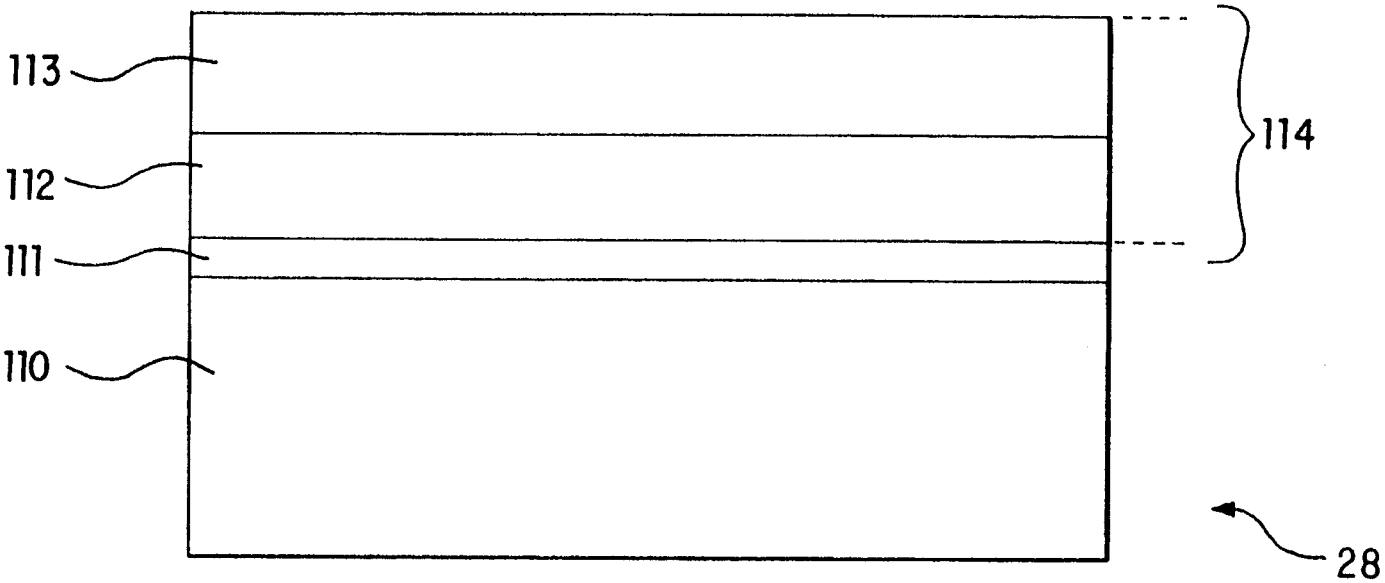
FIG. 3 is a plane side view of the intermediate belt of the invention.

At a transfer station 32, the developed toner image 20c is electrostatically transferred to an intermediate member or belt 28. The intermediate transfer belt 28 of this invention is shown in FIG. 3. The intermediate transfer belt 28 includes a substrate 110. Generally, an insulating material, such as mylar, forms the substrate 110. A conductive layer 111 is preferably formed on the substrate 110; however, the conductive layer 111 may be omitted if the substrate 110 is not made of insulating material. Further, a generating layer 112 is deposited on the conductive layer 111 if used, or directly onto the substrate 110 if the conductive layer 111 is emitted. Subsequently, a transport layer 113 is deposited on the generating layer 112. The photoconductive layer 114, comprising the generating layer 112 and the transport layer 113 is generally a light sensitive layer approximately 20–30 microns thick. When the conductive layer 111 is not used, the generating layer 112 is deposited directly on the substrate 110. Although the following description relates to a photoconductive intermediate belt 28, many other photoconductor structures are known in the art and can be used with this invention.

Typically, the transfer of toner images 20c from a drum 11 to an intermediate belt 28 in electrostatographic applications is accomplished by electrostatic induction using a corotron or other corona generating devices 33. In corona-induced transfer systems, the intermediate belt 28 is placed in direct contact with the toner image 20c while the toner image 20c is supported on the drum 11. By spraying the back of the intermediate belt 28 with an opposite-polarity corona discharge, the toned image 20c on the drum 11 is transferred to the intermediate belt 28. In this invention, corona-induced transfer only practically occurs when the substrate 110 of the photoconductive belt 28 is within a certain resistivity range. In the first embodiment, the substrate 110 has a surface resistivity above approximately $10^7$ ohms/-square (typically a volume resistivity above $10^5$ ohm-cm for a 0.01 cm thick substrate). Otherwise, lateral conduction along the substrate 110 could dissipate the corona charge to any nearby grounded conductors touching the substrate 110 near the transfer zone. On the other hand, if the volume resistivity of the substrate 110 is too high, problems often occur during the steps of charging, imaging and developing the latent image on the photoconductive belt 28, due to the extra charge accumulation on the substrate 110. Conductive backing rollers (not shown) in the critical charging, imaging, and development stations along the photoconductive belt 28, and a substrate 110 having a volume resistivity less than approximately $10^9$ ohm-cm for a 5 in/sec process speed will generally prevent these problems. Thus, a preferred resistivity range for the substrate 110 of the photoconductive intermediate belt 28 for corona transfer is between approximately $10^5$ and $10^9$ ohm-cm for a 5 in/sec process speed. The upper limit of the required resistivity range varies inversely with process speed. Alternatively, in a bias transfer system, a bias roll could be used to apply a potential difference between the conductive substrate 13 of the drum 11 and the substrate 110 of the intermediate belt 28 in the transfer zone of each drum 11.

When the intermediate belt includes the conductive layer 111 between the substrate 110 and the photoconductive layer 114, corona-induced transfer becomes impractical. However, applying a potential difference between the conductive substrate 13 of the drum 11 and the conductive substrate 110 of the intermediate belt 28 transfers the toned image 20c. The applied potential is preferably applied to the drum substrate 13 with the belt substrate 110 being grounded. This allows different potential differences to be applied to the separate imaging drums 11 in a tandem color intermediate transfer printer. These different potentials are needed to compensate for changes in the amount of charge that typically occurs on the surface of the intermediate belt 28 after each successive transfer station 32. However, the potential difference could also be on the intermediate belt substrate 110, with the drum substrate 13 being either grounded or appropriately biased, to create the desired potential difference. Another alternative, usable with conductive substrate 110 on the intermediate belt 28, grounds the substrate 110 and charges the photoconductive surface to the opposite polarity from the toner charge of the image to be transferred. Similarly, the toner bearing photoconductive drum 11 may be charged in the same polarity direction as the toner charge to be transferred. Charging can be done, for example, by corotron, scorotron, or roller charging of the surfaces. The potential above the intermediate belt 28 surface due to the charging will behave equivalently to a bias on the conductive intermediate substrate 110, but the potential above the drum 11 will act opposite in polarity but otherwise similar to a potential applied to the intermediate substrate 110. Of course, appropriate combinations of biased conductive substrates and charged surfaces are within the scope of this invention.

Figure 5:
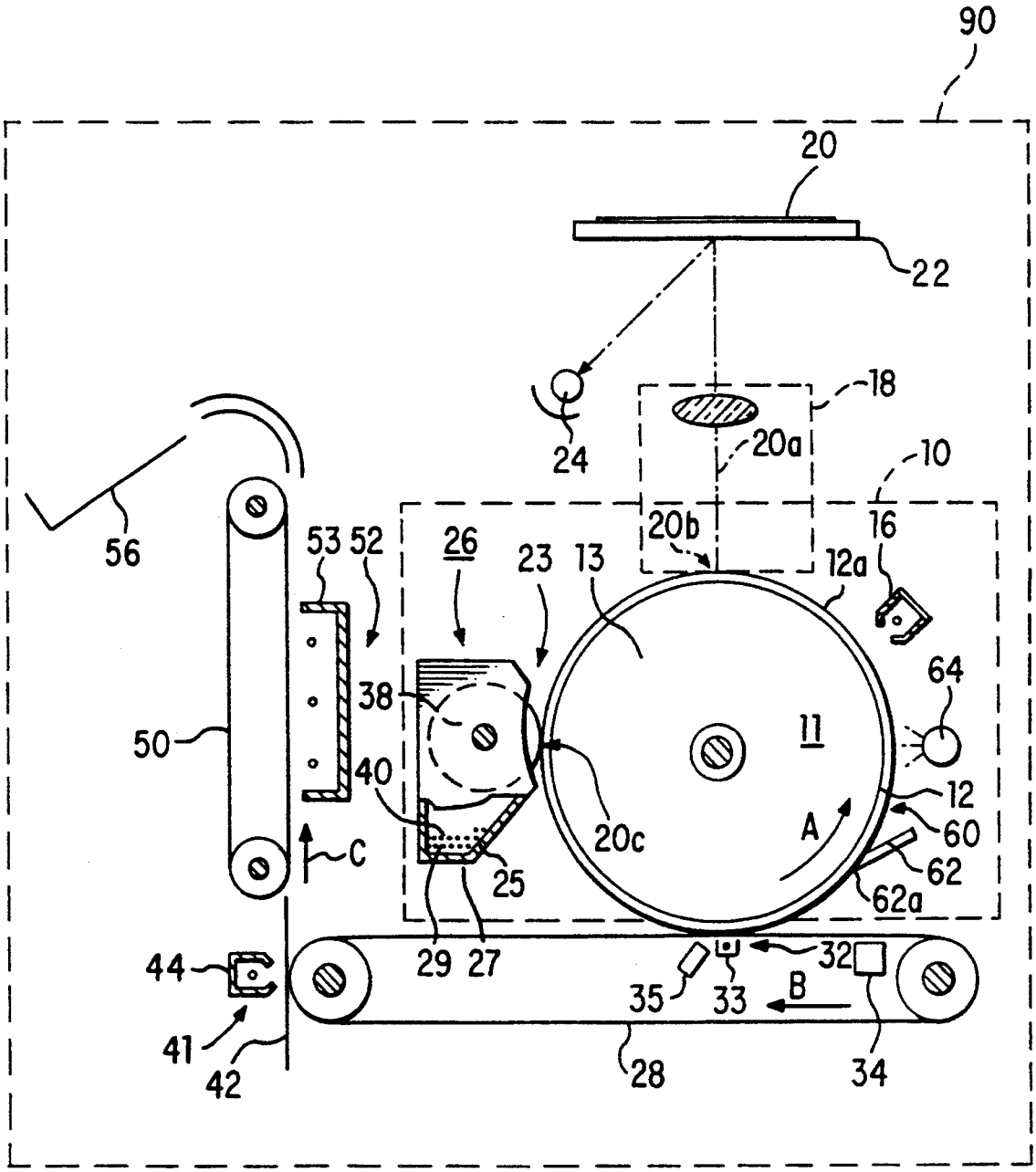
FIG. 5 is a schematic diagram of pertinent portions of the photoreceptive imaging drum system and an intermediate belt transfer member in another embodiment of the present invention.

Adhesive toner layers on the surface of the drum 11 may require high electrostatic fields when transferring the image to or from the photoconductive belt 28, or when the top layers of other toners easily transfer across an air gap. Under these circumstances, the unwanted electrostatic fields prior to intimate contact often causes toner splatter defects in the image because of the unwanted transfer of toner across an air gap. Similarly, the fields can cause defects in the charge patterns, because of the air breakdown between the toner layer and the belt 28 surface, prior to the contact nip between the toner layer and the intermediate belt 28 surface. Therefore, an electrical bias member 34, as shown in FIG. 5, is used to produce low electrostatic fields just prior to the transfer zone and high electrostatic fields for transfer in the contact regions between the intermediate belt surface and the surface of the drum 11.

The electrical biasing member 34 used with a conductive substrate 110 causes unwanted electrostatic fields across the air gaps resulting in defects in the transferred toner image 20*c* when low-adhesion toners are transferred. As shown in FIG. 5, a semiconductive substrate 110 allows the use of a bias member 34 to reduce the electrostatic fields in the regions just prior to the transfer station 32. This bias member 34 also substantially eliminates the unwanted electrostatic fields across the air gaps. This is called "field tailoring." Field tailoring cannot be effectively used when the substrate 110 is conductive. Therefore, in one embodiment with a conductive belt substrate 110, the intermediate belt 28 is appropriately charged prior to the transfer zone to reduce the electrostatic fields across the air gaps prior to the transfer zone. Additionally, a flood light 35 is selectively applied only in the contact nip regions of the intermediate belt 28 and the imaging drum 11 surfaces. The flood light 35 is selectively used to collapse the electrostatic fields in the photoconductive layer 114 and to substantially remove the charge on the photoconductive intermediate belt 28 that otherwise tends to suppress the toner transfer. In the preferred embodiment, the substrate 110 of the photoreceptor belt is partially transparent, so that the light from the flood light 35 shines through the substrate 110. A baffel (not shown) prevents the flood light 35 from exposing the photoconductive intermediate belt 28 in the regions prior to intimate contact of the surfaces of the drum 11 and the intermediate belt 28. Thus, the charge on the intermediate belt 28 suppresses the electrostatic fields in the air gap regions prior to the transfer contact nip. However, this change is substantially eliminated by the flood light 35 in the contact nip. This reduces the unwanted fields in the pre-nip regions before contact of the surfaces and prevents the defects that would otherwise occur when low-adhesion toners are required to be transferred.

Figure 6:
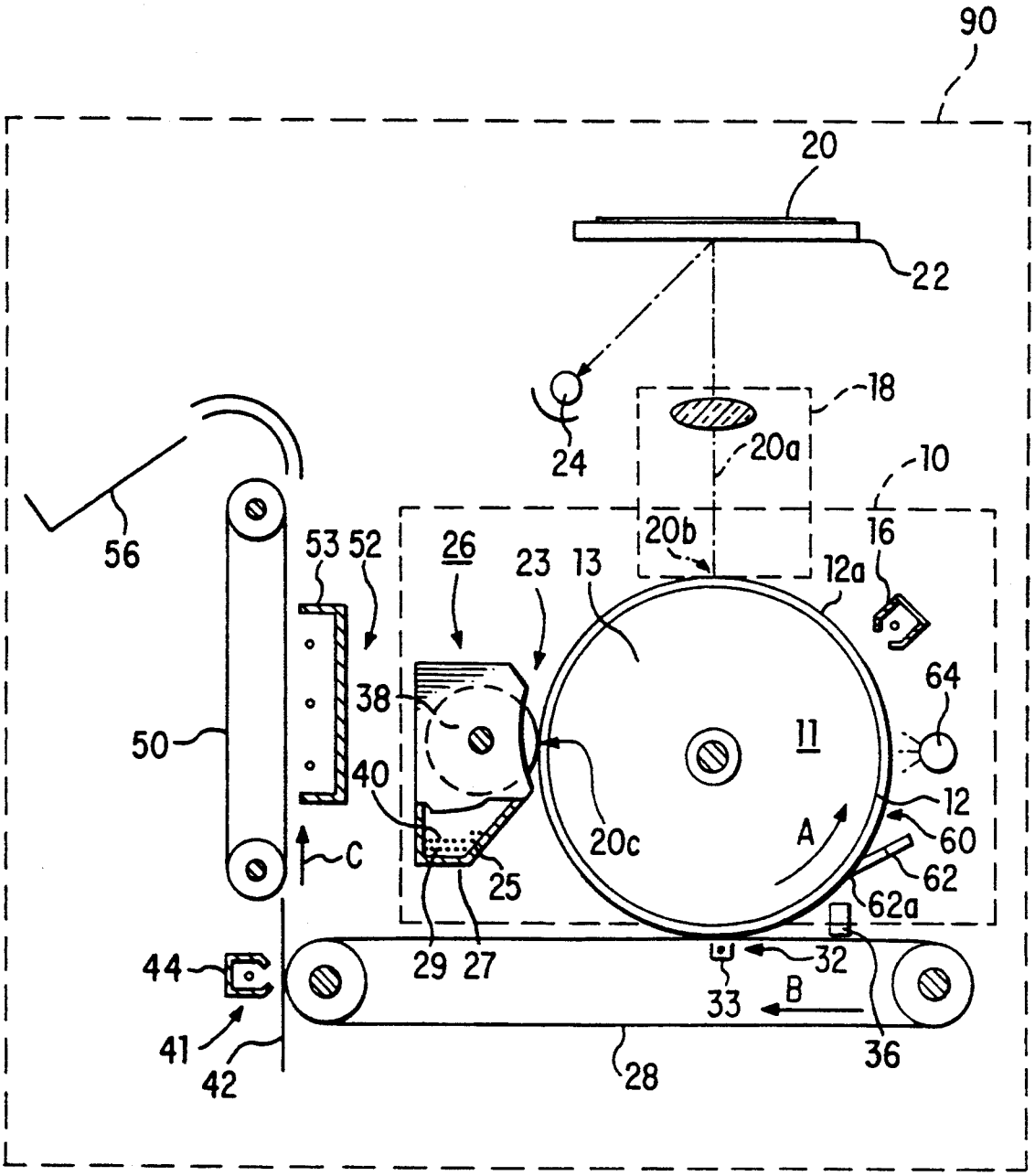
FIG. 6 is a schematic diagram of pertinent portions of the photoreceptive imaging drum system and an intermediate belt transfer member in yet another embodiment of the present invention.

In this embodiment, as shown in FIG. 6, the photoconductive intermediate belt substrate 110 is partially transparent to the light wavelengths appropriate to dissipate the charge on the intermediate belt 28. Charge of the same polarity as the charge on the toner is deposited onto the surface of the intermediate belt 28 prior to the transfer zone by using a corotron 36, scorotron, or any other known charging device. For any given applied potential difference between the belt substrate 110 and the drum substrate 13, the applied same-polarity charge on the intermediate belt 28 surface tends to reduce the applied electrostatic fields used to transfer the toner. Thus, the pre-charge treatment on the belt 28 operates in a similar manner to the biasing members 34 described above.

Figure 7:
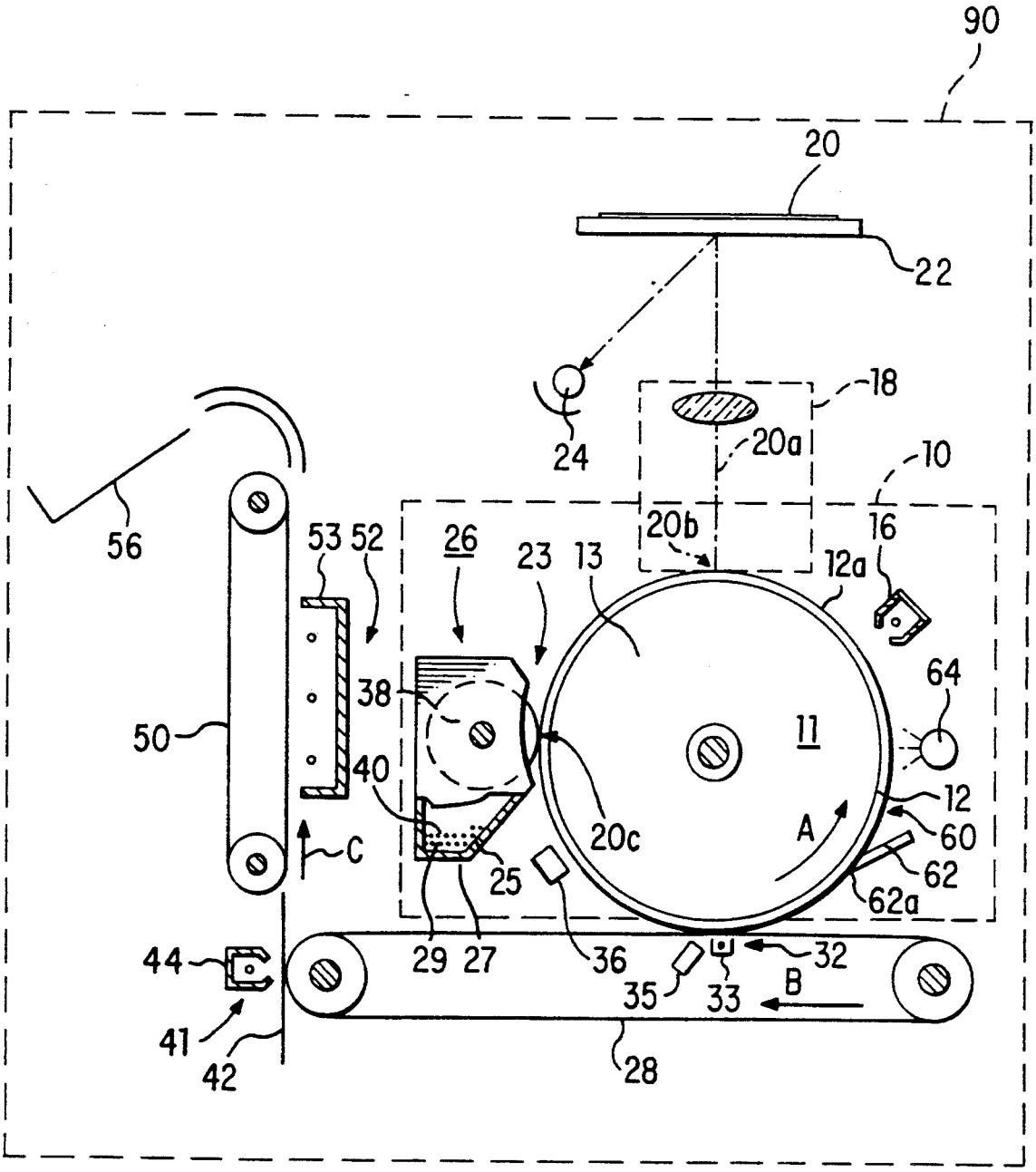
FIG. 7 is a schematic diagram of pertinent portions of the photoreceptive imaging drum system and an intermediate belt transfer member in still yet another embodiment of the present invention.

In another embodiment, as shown in FIG. 7, a semi-transparent substrate is used for the drum substrate 13. This embodiment is not applicable to discharge area development systems. Discharge area development systems develop toner in the discharged areas of the imaging drum 11. However, with charged area development, the charge polarity below and near the toner on the drum 11 is opposite to the polarity of the charge on the toner charge to be transferred. Then the charge below the toner will reduce the unwanted fields in the pre-nip regions before contact of the surfaces. A flood light 35 can then be used to selectively discharge the drum photoconductor through the substrate 13 during the transfer contact zones. This restores high fields in the transfer nip without causing high fields in the pre-transfer nip and therefore prevents the defects that would otherwise occur because of the unwanted fields in the pre-transfer air gaps when low-adhesion toners are required to be transferred.

This embodiment is applicable in charged area development systems. Charged area development systems develop toner in the charged areas of the imaging drum 11. In this embodiment, selective charge treatment of the imaging drum 11 prior to the transfer zone increases the background region potential to a value substantially near the image region potential without adding or reducing the toner charge in the image regions. This is used to enhance the effect of the flood light 35 exposure for a line image or for the edges of images. This selective pre-transfer charge treatment can be accomplished with a single polarity D( scorotron 36, a scorotron or two scorotrons with two different polarities on the charge generating coronodes, or an A( scorotron, all with a grid potential chosen to be substantially near the potential above the solid area developed toner image regions. Selective pre-transfer treatment is well known and practiced in the art of xerography using many approaches for the selective charging devices. It is understood that although drums are referred to in this embodiment, photoconductive belts could also be used.

As the belt 30 advances in the direction of arrow B, the toner image 20*c* transferred to the intermediate belt 30 advances to a transfer station 41 where a copy sheet 42 is advanced synchronously with the toned image 20*c* formed on the belt 30, to transfer the toned image 20*c* to the output copy sheet 42. The transfer station 41 includes, in one embodiment, a corona generating device 44 which sprays ions on the back side of the copy sheet 42. These ions attract the toner particles from the belt 30 to the copy sheet 42. Alternatively, bias transfer rollers and other transfer alternatives are used in the transfer station 41.

After the toner particles are transferred to the copy sheet 42, the copy sheet 42 advances on a conveyor 50 through a fusing station 52. The fusing station 52 generally includes a radiant heater 53. The radiant heater 53 heats the copy sheet 42 to a temperature sufficient to permanently fuse the toner particles to the copy sheet 42. The conveyor belt 50 advances the copy sheet 42 in the direction of arrow C through radiant heater 53 to catch tray 56. The copy sheet 42 may be readily removed from the catch tray 56 by a machine operator.

Invariably, some residual carrier beads and toner particles adhere to the photoconductive surface 12*a* of the drum 11 after the toned image 20*c* is transferred to the belt 28. These residual toner particles and carrier beads are removed from the photoconductive surface 12*a* at a cleaning station 60. The cleaning station 60 includes a flexible, resilient blade 62, which has a free end portion 62*a* contacting the photoconductive layer 12 to remove any adhering material. Thereafter, a lamp 64 is energized to discharge any residual charge remaining on the photoconductive surface 12*a*, , in preparation for a successive imaging cycle.

In conventional tandem colored printing, four successive imaging drums 11, each having a photoconductive layer 12, are required. Each of the imaging drums 11 typically produces one of the tandem colors. The tandem colors generally include black, yellow, magenta and cyan. Each drum 11 produces one toned image, which is separately transferred to the intermediate belt 30.

Figure 2:
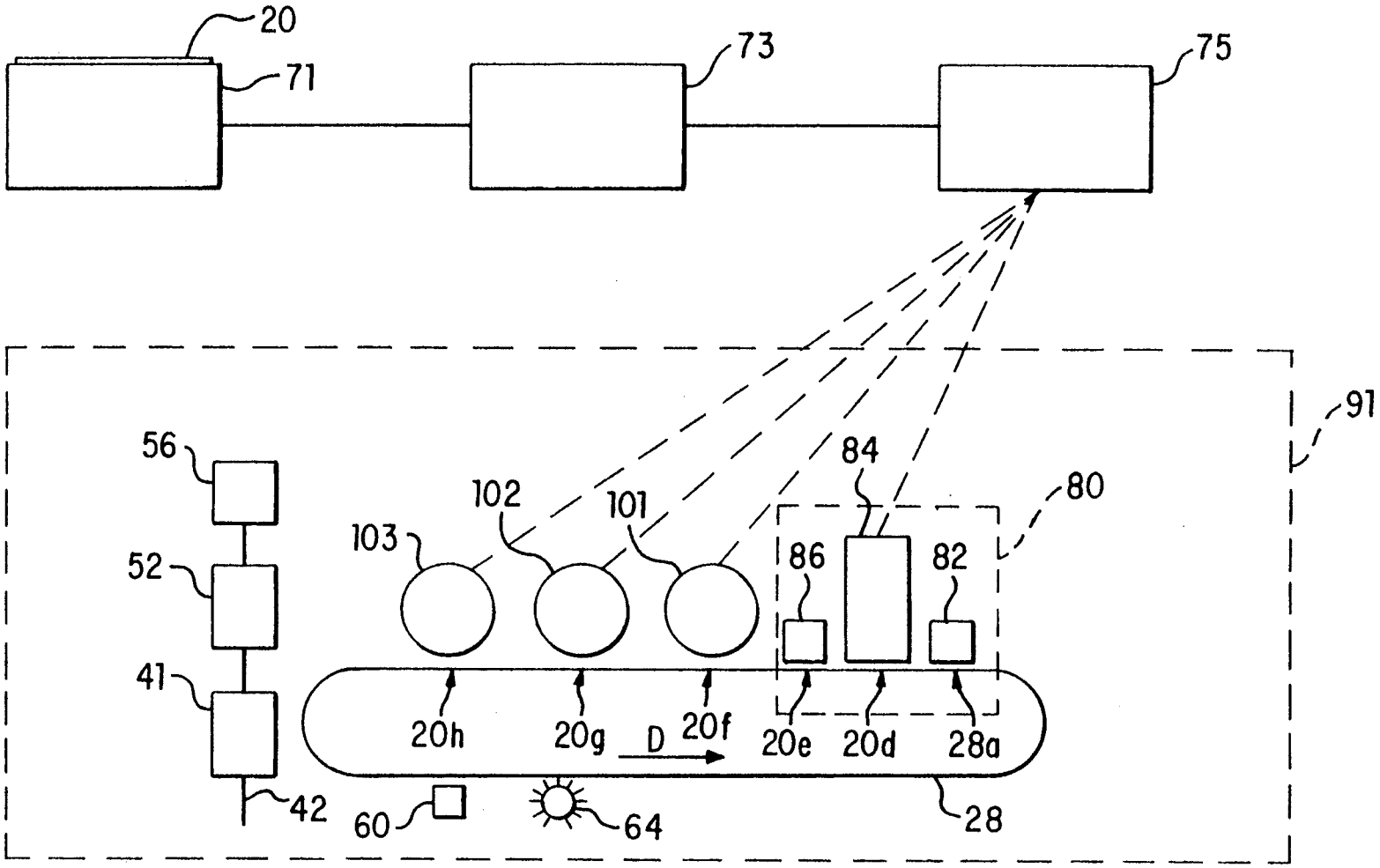
FIG. 2 is a schematic diagram of an electrostatographic printing machine incorporating the features of the preferred embodiment of the invention.

A first preferred embodiment of this invention is shown in FIG. 2. A multi-colored original document 20 is positioned on a raster input scanner (RIS) 71. The RIS 71 includes document illumination lamps, optics, a mechanical scanning device, and a charge couple device (not shown). The RIS scans the document and converts the image on the document into electronic image data organized as a series of raster scan lines. The electronic image data includes data indicative of the primary color densities, for example, the red, green and blue densities, at each point of the image on the original document 20. Alternatively, the electronic image data is output by any appropriate source. The electronic data is transmitted to an image processing system (IPS) 73. The IPS 73 includes control electronics which prepare and manage the electronic image data flow to the raster output scanner (ROS) 75. The ROS 75 outputs the electronic image data as a series of raster scan lines by modulating a laser beam or the like. Each raster scan line has a specified number of pixels per inch. The ROS 75 selectively outputs the laser beam to one of a plurality of photoreceptive surfaces depending on which tandem color image 20c is to be formed. The light is focused by use of mirrors and lenses (not shown) on a photoconductive surface of either the intermediate belt 28 or one of the image forming devices 10.

In a tandem color printer employing four photoreceptive drums, the intermediate transfer belt 28 allows four successive toner images 20c to be transferred from the photoreceptive drums 11 to the intermediate belt 28 and eventually to a copy sheet 42. In a conventional tandem color printer, the four photoreceptive drums 11 sequentially form and transfer yellow, magenta, cyan, and black toner images 20c to the intermediate belt 30 in proper registration with each other.

As shown in FIG. 2, the intermediate belt 28 rotates in the direction of arrow D. Timing detectors (not shown) sense the rotation of the intermediate belt 28 and output control signals to the controller (not shown) to synchronize the operation of printing engine 91. FIG. 2 shows three imaging devices 101, 102 and 103 and a second image forming device 80. The second image forming device 80 charges a portion 28a of the photoconductive layer 114 of the belt 28, forms a latent image 20d in the photoconductive layer 114, and develops the latent image 20d to form a visible toned image 20e. Initially, a corona generating device 82 sprays ions onto a portion 28a of the photoconductive layer 114 of the belt 28 as it passes under the corona generating device 82 to produce a relatively high, substantially uniform charge on the portion 28a of the belt 28.

Once the belt 28 is charged, the belt 28 rotates the charged portion 28a to an exposing device 84, where an image of an original document 20 is projected onto the charged portion 28a. The exposing device 84 projects an image onto the charged portion 28a of the photoconductive layer 114. The projected image selectively dissipates the charge on the photoconductive layer 114 to form a latent electrostatic image 20d in the photoconductive layer 114 of the belt 28. While the preceding description relates to a light lens system, one skilled in the art will appreciate that other devices, such as a ROS using a modulated laser beam, may be employed to selectively discharge the charge on the charged portion 28a to form the latent electrostatic image 20d.

After exposure, the latent electrostatic image 20d in the photoconductive layer 114 of the intermediate belt 28 rotates to a development device 86. The development device 86, in one embodiment, operates in similar manner to the development station 23 of FIG. 1. In like manner, the developing material 25 is brought into contact with the photoconductive layer 114 of the belt 28. The latent electrostatic image 20d in the photoconductive layer 114 attracts the toner particles 27 of the developing material 25 to develop the latent electrostatic image 20d into a toned image 20e on the photoconductive layer 114 of the belt 28.

In the preferred embodiment, the development device 86 forms a visible toned image 20e from the latent electrostatic image 20d on the belt 28. The image formed in this example is black, but other color choices and subsequent color sequences other than black are allowed. This toned image 20e and the intermediate belt 28 rotate to the transfer region of the first of the three imaging devices 101, 102 and 103. In the preferred embodiment, the first imaging device 101 forms and transfers a yellow toned image 20c to the belt 28.

As described above, the first imaging device 101 transfers a yellow toned image 20c to the belt 28. The controller (not shown) carefully controls the position of the belt 28 when actually transferring each of the toned images 20c to the belt 28. It is important that the black toned image 20e on the intermediate belt 28 is properly aligned and in substantially perfect registration with the first imaging device 101 so that the two-toned image 20f that is produced will be properly aligned. After the yellow toned image 20c transfers to the intermediate belt 28, the visible image 20f on the belt 28 comprises two tones- black and yellow.

The black-yellow toned image 20f and the intermediate belt 28 subsequently rotate to the transfer region of the second one of the imaging devices 102. In the preferred embodiment, the second one of the imaging devices 102 forms and transfers a magenta toned image 20c onto the belt 28. The imaging device 102 transfers the magenta toned image 20c onto the intermediate belt 28 in proper alignment and registration with the black and yellow two-toned image 20f. Thus, a three-toned image 20g is formed comprising black, yellow and magenta. It is understood that any ordering of the colored toners is capable of use with this invention.

The belt 28 and the three-toned image 20g continue rotating to the transfer region of the third one of the imaging devices 103 to transfer a cyan toned image 20c onto the belt 28. Thus, a four-toned image 20h is formed on the belt 28 by this tandem printing operation.

It is to be understood that the three imaging devices 101, 102 and 103, the development device 86, the exposing device 84, the corona generating device 82 and the intermediate belt 28 must be precisely controlled by the controller (not shown) to ensure that each toned image properly registers with each other to form the multi-toned image 20h.

As the intermediate belt 28 advances in the direction of arrow D, the four-toned image 20h on the belt 28 advances to the transfer station 41 where the copy sheet 42 advances synchronously with the toner particle images on the intermediate belt 28 to transfer the image 20h to the output copy sheet 42. As explained above, the transfer station 41 includes a transfer field generating device such as a bias transfer roller or a corona generating device which sprays ions onto the back side of the copy sheet 42 to attract the toner particles from the intermediate belt 28 to the copy sheet 42.

In similar manner to that described above, after the toner particles are transferred to the copy sheet 42, the copy sheet 42 advances to a fusing station 52. The fusing station 52 fuses the toner particles onto the copy sheet 42. The copy sheet 42 then advances to a catch tray 56, where it is available to a machine operator.

Some residual carrier beads and toner particles adhere to the photoconductive surfaces of the photoreceptive imaging drums 101, 102 and 103 and the intermediate belt 28. These residual toner particles and carrier beads are removed from the surfaces by a cleaning device 60 as described above. The cleaning device 60 may include a flexible resilient blade having a free end portion placed in contact with the photoconductive layer 12 of the photoreceptive imaging drums 11 and the photoconductor layer 114 of the intermediate belt 28 to remove any adhering material. Furthermore, a lamp 64 may be energized to discharge any residual charge on either the photoconductive surface 12*a* of the imaging drums or the photoconductive layer 114 of the intermediate belt 28 to prepare the system for the next successive imaging cycle.

Figure 4:
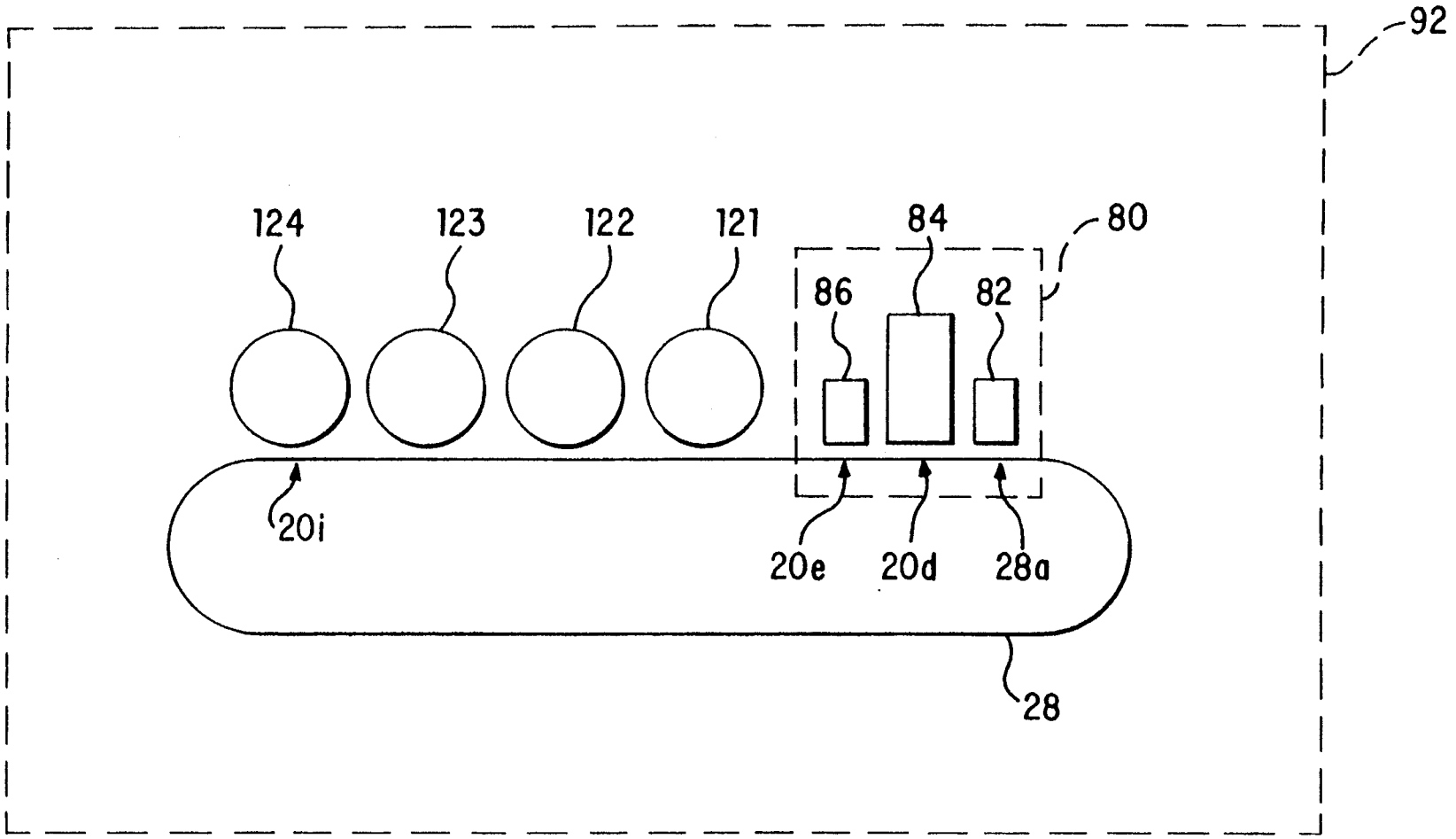
FIG. 4 is a schematic diagram of an electrostatographic printing machine incorporating the features of the second embodiment of the invention.

A second embodiment of the invention is shown in FIG. 4. This second preferred embodiment uses four first imaging devices 121, 122, 123 and 124 and a second image forming device 80. The copying apparatus of the second preferred embodiment operates similar to the copying apparatus of the first preferred embodiment except that an additional imaging system for an additional color toner is added. Occasionally, a user needs to use a specialty color in the printing operation. Such a specialty color is often used with a company's logo or other types of distinguishing marks. Therefore, the print engine 92 must be physically large enough to accommodate five imaging devices. It is additionally possible to expand the copying apparatus of the second preferred embodiment to use five or more first imaging devices and a second image forming device 80. Thus, in addition to the tandem colors of black, magenta, cyan and yellow, a plurality of specialty colors may be used as needed.

In the second embodiment, a second image forming device 80 is employed in similar manner to that described above. The charging unit 82 charges a portion 28*a* of the photoconductive layer 114 of the intermediate belt 28 to a uniform charge. The exposing device 84 then forms a latent electrostatic image 20*d* in the photoconductive layer 114 of the intermediate belt 28. The developing device 86 then applies toner to the latent electrostatic image 20*d* corresponding to the specialty color portions of the image of the original document 20. Thus, a visible specialty color toned image 20*e* forms on the belt 28. The visible toned image 20*e* then rotates with the intermediate belt 28 to each of the respective transfer regions of the four imaging devices 121, 122, 123, and 124 to separately transfer toned images 20*c* corresponding to black, yellow, magenta, and cyan to the toned image 20*e* already on the belt 28. Thus, the toned image produced by the print engine 92 is a five-toned image 20*i* comprising the four tandem colors and the one specialty color.

Of course, not every toned image 20*i* produced will use all five toner colors. Thus, in any one of the four first imaging devices 121, 122, 123 and 124 or the second image forming device 80, a visible toned image corresponding to the respective color of the device can be omitted, depending on the colors present in the image of the original document 20.

If six toner colors are needed, five first image forming imaging devices and one second image forming device 80 are used. In this case, one of the photoreceptive drums forms and transfers one of the specialty color toned images and the other specialty color toned image is formed by the second image forming device 80.

While this invention has been described in conjunction with a specific apparatus, it is evident that many alternatives, modifications and variations will be apparent to those skilled in the art. While various preferred embodiments of this invention are described, it is understood that this invention is not limited to the preferred embodiments. Rather, this invention is intended to cover all alternatives, modifications and equivalents within the spirit and scope of the invention, as defined by the appended claims.

What is claimed is:

1. An image forming apparatus forming a multi-colored copy image of a multi-colored original image on an image receiving member, the multi-colored copy image comprising a plurality of color layers, the image forming apparatus comprising:

a photoconductive belt;

first charging means for charging a portion of the belt;

first image forming means for forming a latent electrostatic image in the charged portion of the belt;

first developing means for developing the latent electrostatic image into a first developed image, the first developed image forming a first one of the plurality of color layers;

a plurality of second image forming means, each second image forming means forming a second developed image, the second developed image of each second image forming means being another one of the plurality of color layers;

a plurality of first image transferring means, each for transferring one of the second developed images from the corresponding one of the plurality of second image forming means to the charged portion of the belt to form the multi-colored image; and second image transferring means for transferring the multi-colored copy image formed on the charged portion of the belt to the image receiving member.

2. The image forming apparatus of claim 1, wherein the first one of the plurality of color layers is black.

3. The image forming apparatus of claim 1, wherein the color layers comprise black, magenta, cyan and yellow.

4. The image forming apparatus of claim 3, wherein the first color layer is one of the black, cyan, magenta and yellow color layers and the plurality of second color layers comprise the others of the black, cyan, magenta and yellow color layers.

5. The image forming apparatus of claim 1, wherein the first color layer is a specialty color.

6. The image forming apparatus of claim 5, wherein the plurality of second color layers comprise black, magenta, cyan and yellow color layers.

7. The image forming apparatus of claim 1, wherein each of the plurality of second image forming means comprises:

a photoconductive member;

a second charging device;

an exposing device; and a second developing device.

8. The image forming apparatus of claim 7, wherein the photoconductive member is a drum.

9. The image forming apparatus of claim 7, wherein the photoconductive member is a second belt.

10. The image forming apparatus of claim 7, wherein the second charging device is a corona generating device.

11. The image forming apparatus of claim 7, wherein:

the apparatus further comprises a plurality of light emitting means for emitting light into a transfer zone of each second image forming means, each transfer zone located between each of the second image forming means and the belt; and the second image forming means further comprises third charging means for charging the second developed image on the photoconductive member prior to transferring the second developed image to the belt.

12. The image forming apparatus of claim 11, wherein the light emitting means is a flood light.

13. The image forming apparatus of claim 11, wherein the third charging means is one of a DC scorotron and an AC scorotron.

14. The image forming apparatus of claim 1, wherein the first charging means is a corona generating device.

15. The image forming apparatus of claim 1, wherein the first image transferring means is a corona generating device.

16. The image forming apparatus of claim 1, wherein the first image transferring means is a bias transfer roller.

17. The image forming apparatus of claim 1, wherein the second image transferring means is a corona generating device.

18. The image forming apparatus of claim 1, wherein the second image transferring means is a bias transfer roller.

19. The image forming apparatus of claim 1, wherein the photoconductive belt comprises a photoconductive layer and a substrate.

20. The image forming apparatus of claim 19, wherein the photoconductive belt further comprises a conductive layer formed between the photoconductive layer and the substrate.

21. The image forming apparatus of claim 19, wherein the substrate has a resistivity between approximately $10^5$ and $10^9$ ohm-cm.

22. The image forming apparatus of claim 21, wherein:

the substrate is transparent; and the image forming apparatus further comprises:

a plurality of second charging means for charging the photoconductive belt with a same polarity charge as each second developed image, each one of the second charging means located in an upstream direction from a transfer zone of each of the second image forming means, each transfer zone located between the second image forming means and the belt; and a plurality of light emitting means for emitting light into the transfer zone of each second image forming means.

23. The image forming apparatus of claim 22, wherein the second charging means is one of a corotron and a scorotron.

24. The image forming apparatus of claim 22, wherein the emitting means is a flood light.

25. The image forming apparatus of claim 21, wherein the apparatus further comprises:

a plurality of biasing means for applying an electrical bias on the substrate prior to a transfer zone of each of the second image forming means, each transfer zone located between the second image forming means and the belt; and a plurality of light emitting means for emitting light into the transfer zone of each of the second image forming means.

26. The image forming apparatus of claim 25, wherein the light emitting means is a flood light.

27. The image forming apparatus of claim 25, wherein the biasing means is a bias transfer device.

* * * * *